United States Patent [19]

Jackson et al.

[11] Patent Number: 5,065,773

[45] Date of Patent: Nov. 19, 1991

[54] WEIGHTLIFTER'S BELT

[76] Inventors: Efram W. Jackson, 5017 Thompson Dr., Colony, Tex. 75056; Aaron Jackson, Jr., 501 W. Horton, #24, Brenham, Tex. 75206

[21] Appl. No.: 566,106

[22] Filed: Aug. 13, 1990

[51] Int. Cl.[5] ..... A61F 5/37; A61F 3/02; A63B 21/072; A63B 21/00

[52] U.S. Cl. ..... 128/876; 272/123; 272/143; 2/338

[58] Field of Search ..... 128/78, 876; 272/123, 272/143; 273/DIG. 11, 30, 189; 2/238, 239, 312, 311, 317, 318, 323

[56] References Cited

U.S. PATENT DOCUMENTS

| | | | |
|---|---|---|---|
| 1,840,945 | 1/1932 | Guinzburg | 2/338 |
| 2,241,267 | 5/1941 | Near | 2/338 |
| 2,884,647 | 5/1959 | Cuttler | 2/338 |
| 3,057,354 | 10/1962 | Roberts | 2/319 |
| 3,751,031 | 8/1973 | Yamauchi | 273/143 |
| 3,848,271 | 11/1974 | Goele | 2/338 |
| 3,858,244 | 1/1975 | Mann | 2/338 |
| 4,172,453 | 10/1979 | Leckie | 128/878 |
| 4,220,328 | 9/1980 | Crush, Jr. | 272/143 |
| 4,396,013 | 8/1983 | Hasslinger | 128/876 |
| 4,968,027 | 11/1990 | Anderson | 2/338 |

*Primary Examiner*—Robert A. Hafer
*Assistant Examiner*—Michael Brown
*Attorney, Agent, or Firm*—Larry B. Dwight

[57] ABSTRACT

This invention relates to a weight lifting belt which includes grips for a trainer to assist in training a lifter the proper techniques for lifting.

3 Claims, 1 Drawing Sheet

WEIGHTLIFTER'S BELT

BACKGROUND OF INVENTION

1. Field of Invention

This invention relates to the field of weightlifting and it particularly relates to a device for allowing a trainer to assist a person in weightlifting for preventing injury due to the induced stresses on the lower back area of the weightlifter.

2. Description of Prior Art

It has been the practice of weightlifters to employ a wide belt across the abdomen to prevent arching of the back and to reinforce the stomach muscles in the weightlifting process. In the past when assisting or training an individual weightlifting the trainer has not had any mechanism to assist him in training the lifter to lift straight up or to guard against imbalance of the weights. Numerous devices such as those disclosed in Altner U.S. Pat. No. 4,802,667 disclosed the use of belts; and belt tightening devices such as that disclosed in Shea in U.S. Pat. No. 4,509,214 but do not provide any mechanism for the trainer to assist the trainee.

BRIEF SUMMARY OF INVENTION

The invention relates to a weightlifting belt for use in conducting and training a weightlifter in the proper method of lifting the weight. The training belt of the present invention comprises a singular wide belt with buckles which is placed around the abdominal area of the lifter. A pair of hand grips spaced on the belt to align over the rear outer portions of the hip to permit a trainer to grab the belt and assist the trainee or weightlifter in performing the desired move in lifting the weight.

The primary object of the invention is to provide grips for a trainer to assist a trainee and if proper movement used in lifting the weights.

Another object of the invention is to permit assistance in lifting heavy weights to guard against back injury or dropping the weight because of becoming unbalanced.

Still other and further objects of the invention will become apparent upon reading the detailed description hereinafter following.

BRIEF DESCRIPTION OF THE DRAWINGS

Numeral references are used to designate like parts throughout the various figures of the drawing.

DETAILED DESCRIPTION

Figure 1:
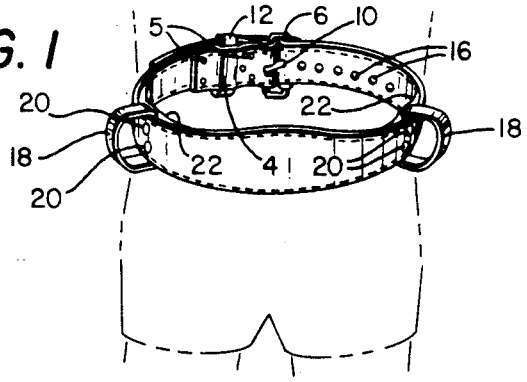
FIG. 1 is a rear perspective view of the invention depicted on the waist of a silhouette user.
Figure 2:
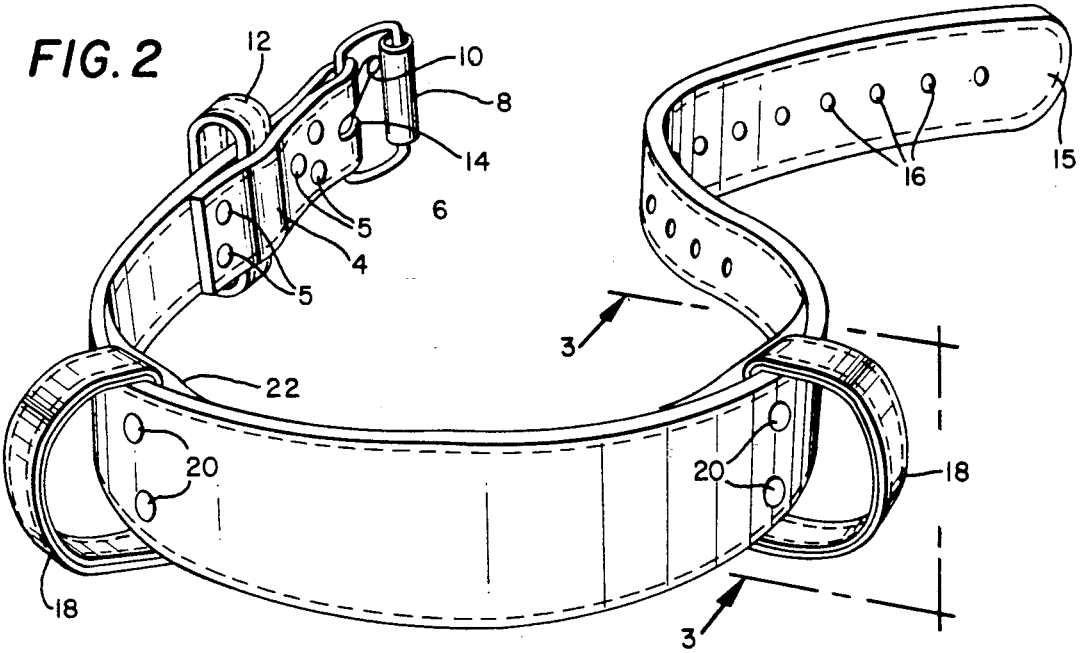
FIG. 2 is a rear perspective view of the belt unbuckled.
Figure 3:
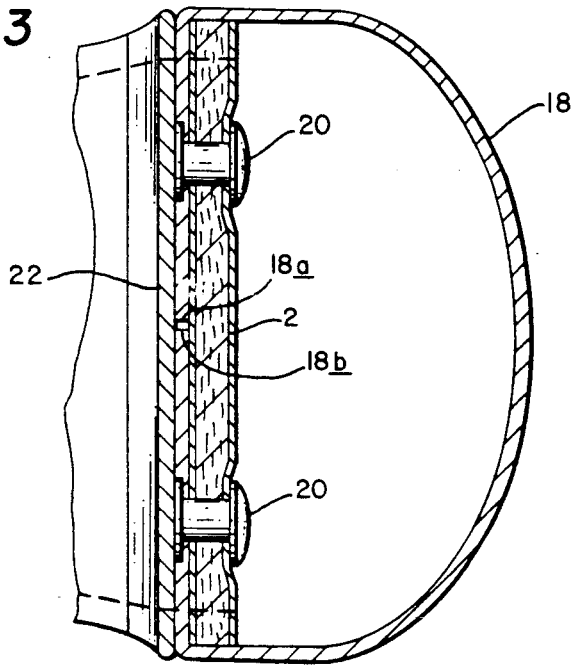
FIG. 3 is a cross-sectional view taken along line three of figure two.

Referring to FIGS. 1 and 2, the weightlifting belt comprises a heavy wide belt with ends which overlap each other of a material such as heavy, thick leather to having a first end secured around the rectangular metal loop 6 by rivets 5. The rivets 5 are located on each side of a belt loop 12 which secures the free end of the belt after it is fastened in the buckle. Rectangular metal loop 6 or buckle has a roller 8 which allows tightening the belt more easily. A tongue 10 is looped around the rectangular loop 6 through a slot 14 formed in the belt 2 in a typical belt buckle fashion. The other end 15 of belt 2 has spaced apertures 16 formed therein to receive the tongue member 10 through the apertures 16 when the belt is tightened around the waist of the user. The multiple apertures 16 make the belt adjustable to the waist of the user. Stiff hand grips 18 are spaced and secured to belt 2 in a position just over the rear outer portions of the hip bone of the user. Hand grips 18 are comprised of a stiff semi rigid material such as heavy leather formed from a strip which is secured to belt 2 by brads or rivets 20 as more specifically shown in FIG. 3. The free ends 18*a* and 18*b* of the strip of material forming the hand grips 18 are folded over the interior side of belt 2 and secured by heavy brads or rivets 20 so that the entire hand grip forms a semi rigid grip 18 to assist the trainer in lifting the body and guiding the body of the weightlifter. A pad 22 is secured over the inside area of the belt 2, rivets 20 and ends 18*a* and 18*b* of grip 18 to prevent chafing of the user's body. The spacing of the grips 18 is approximately between 90 and 180 degrees apart with the preferred spacing being 120 degrees apart such the correspond to the rear of the user.

Thus the trainer can grip handgrips 18 while weightlifter is attempting to lift a heavy weight or is starting his practice lifts with lighter weights. In this fashion the trainer can adjust to keep the back of the weight lifter straight or prevent the weightlifter from becoming unbalanced and assist him in moving with his back straight in a straight upward movement to prevent injuries to his back and show him the preferred method of lifting.

The position of the hand grip 18 is located that they are spaced a the outer portions of the hip to facilitate maximum control of the weight lifter in assisting and teaching him the preferred method of weight lifting.

We claim:

1. A weight lifting belt to be used by a weight lifter comprising: a wide, heavy leather belt having ends which overlap each other; means to adjustably secure the ends of said belt together around the weight lifter; a pair of spaced hand grips spaced along the belt between 90 to 180 degrees apart and aligned over the outer rear buttock of the weight lifter, each of said spaced hand grips comprising a strip of elongated semi-rigid material having ends which are joined to said belt on the interior side of the belt; and means to rigidly secure the ends of the grips to the belt.

2. The combination called for in claim 1 wherein the semi-rigid material is heavy leather.

3. The combination called for in claim 1 wherein the means to secure said grip comprises brads secured through the grip and belt.

* * * * *